US005701052A

United States Patent [19]

Kim et al.

[11] Patent Number: 5,701,052

[45] Date of Patent: *Dec. 23, 1997

[54] DIRECTLY HEATED CATHODE STRUCTURE

[75] Inventors: Chang-seob Kim; Seok-bong Son, both of Suwon; Sang-kyun Kim; Bong-uk Jeong, both of Seoul, all of Rep. of Korea

[73] Assignee: Samsung Display Devices Co., Ltd., Kyungki-do, Rep. of Korea

[ * ] Notice: The term of this patent shall not extend beyond the expiration date of Pat. No. 5,668,434.

[21] Appl. No.: 579,519

[22] Filed: Dec. 27, 1995

[30] Foreign Application Priority Data

Dec. 29, 1994 [KR] Rep. of Korea ..... 94-38999

[51] Int. Cl.[6] ..... H01J 1/14; H01J 19/06; H01K 1/04

[52] U.S. Cl. ..... 313/346 R; 313/345; 313/346 DC

[58] Field of Search ..... 313/238, 269–70, 313/337, 345, 346 DC, 346 R, 355, 411, 451

[56] References Cited

U.S. PATENT DOCUMENTS

| | | | |
|---|---|---|---|
| 3,495,122 | 2/1970 | Hübner et al. | 313/346 |
| 3,671,792 | 6/1972 | Waltermire | 313/337 |
| 4,313,854 | 2/1982 | Sunahara et al. | 313/346 R |
| 4,349,766 | 9/1982 | Ando et al. | 313/345 |
| 4,350,920 | 9/1982 | Bertens | 313/346 R |
| 4,823,044 | 4/1989 | Falce | 313/346 |
| 4,843,277 | 6/1989 | Winkler et al. | 313/346 R |
| 5,057,736 | 10/1991 | Noda et al. | 313/346 R |

FOREIGN PATENT DOCUMENTS

| | | |
|---|---|---|
| 8705725 | 11/1987 | Denmark . |
| 015634 | 10/1985 | European Pat. Off. . |
| 60-59641 | 4/1985 | Japan . |
| 61-51723 | 3/1986 | Japan . |
| 61-163532 | 7/1986 | Japan . |
| 61-0216222 | 9/1986 | Japan . |
| 2060246 | 10/1979 | United Kingdom . |

*Primary Examiner*—Sandra L. O'Shea
*Assistant Examiner*—Mack Haynes
*Attorney, Agent, or Firm*—Leydig, Voit & Mayer, Ltd.

[57] ABSTRACT

A directly heated cathode structure includes a porous pellet impregnated with a cathode material, a first metal member fixed to a surface of the porous pellet, a second metal member welded to the first metal member, and a filament interposed between the first and second metal members. A method for manufacturing a directly heated cathode structure includes manufacturing a porous pellet having a multiplicity of cavities, welding a first metal member to a surface of the porous pellet with a brazing layer, impregnating the cavities of the pellet with an electron radiating material, and welding a second metal member to the first metal member with a filament disposed between the first and second metal members. The useful life of the cathode structure is prolonged since thermions are not emitted through the surface of the pellet covered by the metal member.

23 Claims, 3 Drawing Sheets

DIRECTLY HEATED CATHODE STRUCTURE

BACKGROUND OF THE INVENTION

The present invention relates to a directly heated cathode structure for a cathode-ray tube (CRT), and more particularly, to a directly heated dispenser cathode structure for use in a color CRT electron gun and a method for manufacturing.

Cathodes for absorbing heat energy and emitting thermions can be divided into two categories according to the heating manner a directly heated type and an indirectly heated type. In the direct-heated cathode, the filament and the thermion emission source are in direct contact with each other, and a structure is provided for the filament and thermion emission source in the indirect-heated cathode.

Contrary to the indirectly heated cathode which is generally applied to an electron gun requiring a great quantity of thermions, the directly heated cathode is used for an electron gun of a small CRT such as a built-in viewfinder of a video camera. The directly heated cathode is generally directly fixed to a filament and provided with a base metal, whose surface is coated with electron-radiating material or a pellet into which cathode material is impregnated.

The present applicant has filed U.S. patent application having a porous pellet which No. 08/120,502 now abandoned for a structure is directly fixed to a filament. This structure is shown in FIG. 1. In the structure shown in FIG. 1, a pair of filaments 102 and 102' are directly welded to opposing sides of a porous pellet 101 wherein electron-radiating material is impregnated. Alternately, a single filament may penetrate porous pellet 101.

The present applicant has also filed a U.S. patent application (No. 08/429,529) disclosing a cathode structure in which the supporting strength for the pellet is provided by filaments and is reinforced. That is, the filaments are directly welded to (or penetrate at) least three points on the porous pellet in which the electron-radiating material is impregnated.

The above-mentioned directly heated cathode structures need only a very short interval for starting thermion emission after current is applied and exhibit high-density thermion emission, since the filament is in contact with the pellet body itself and the porous pellet is directly heated by the filament current. However, there is a possibility of loss of thermions since the thermionic emission occurs over the entire surface of the pellet (i.e., including the sides thereof). Also, the thermion-radiating material evaporated from the pellet becomes attached to the filament, thereby embrittling the filament. Further, the process of securing the filament to the pellet (either by welding or passing it through the pellet) is difficult in practice, resulting in lower productivity.

Further, the present applicant has also developed a directly heated cathode having an improved structure, as shown in FIG. 2. Here, a filament 210 is fixed to a metal member 220 which is arranged under a pellet 200 where electron radiating material is impregnated. Thus, since metal member 220 covers the lower surface of pellet 200, thermion emission through the lower surface of pellet 200 is effectively blocked. However, a small portion of the thermions escape through minute gaps which exist between pellet 200 and metal member 220. Moreover, since the sides of the pellet also comprise thermionic emission surface area, continuous and uniform thermionic emission cannot be achieved. Further, the life of pellet 200 is shortened due to the rapid consumption of the electron radiating material, and, as in the case of the aforementioned structure, the attached electron-radiating material evaporated from the sides of pellet 200 to the filament embrittles the filament.

SUMMARY OF THE INVENTION

To solve the above problems, it is an object of the present invention to provide a directly heated cathode structure and a method for manufacturing a directly heated cathode wherein emission of electron radiating material through the lower surface of a pellet is prevented and the structure thereof is stabilized to provide a quality and productivity improvement.

Accordingly, to achieve the above object, there is provided a directly heated cathode structure comprising a porous pellet in which cathode material is impregnated, a first metal member being fixed to the lower surface of the porous pellet, a second metal member being welded to the first metal member, and a filament disposed between the first and second metal members.

To achieve the above object, there is provided a method for manufacturing a directly heated cathode structure comprising the steps of manufacturing a porous pellet having a multiplicity of cavities, welding a first metal member to the lower surface of the porous pellet by a brazing layer, impregnating electron radiating material into the cavities of the pellet, and welding a second metal member to the first metal member so that a filament is fixed between the first and second metal members.

Further, another method for manufacturing a directly heated cathode structure is provided which comprises the steps of manufacturing a porous pellet having a multiplicity of cavities, impregnating electron radiating material into the cavities of the pellet, welding a first metal member to the lower surface of the porous pellet by a brazing layer, and welding a second metal member to the first metal member so that a filament is disposed between the first and second metal members.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
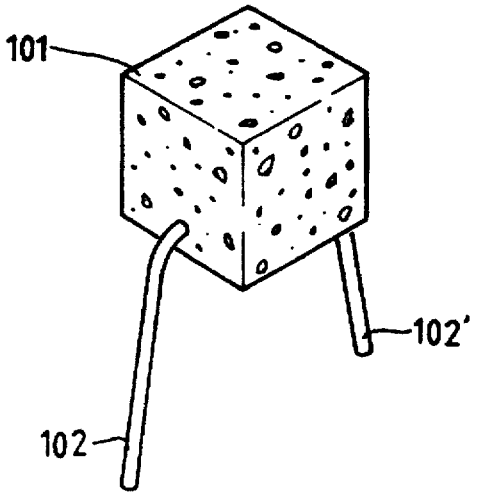
FIG.1(PRIOR ART)
FIG. 1 is a perspective view schematically illustrating a conventional directly heated cathode structure.
Figure 2:
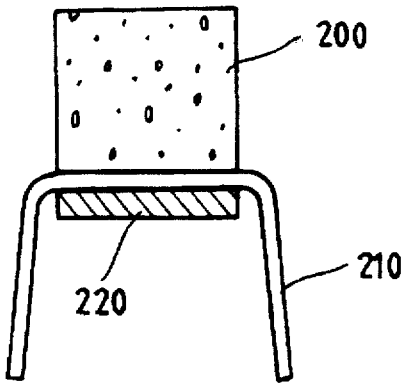
FIG.2(PRIOR ART)
FIG. 2 is a section schematically illustrating another conventional directly heated cathode structure.
Figure 3:
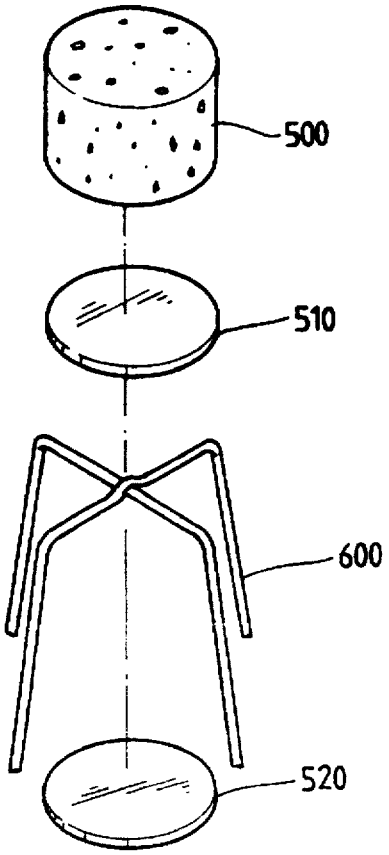
FIG. 3 is an exploded perspective view illustrating a directly heated cathode structure according to the present invention.
Figure 4:
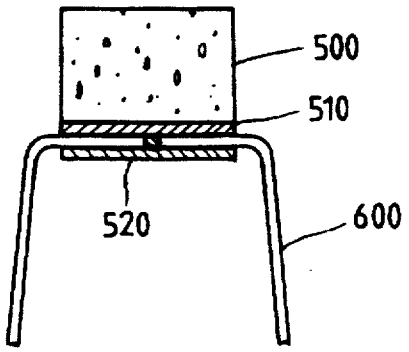
FIG. 4 is a section illustrating the assembled directly heated cathode structure shown in FIG. 3.

FIGS. 3 and 4 show an exploded perspective view and a assembled sectional view, respectively, of a preferred embodiment of a directly heated cathode structure according to the present invention.

The directly heated cathode structure comprises a porous pellet 500 which is impregnated with electron radiating material, a first metal member 510 fixed to the lower surface of a pellet 500 by brazing, a filament 600 disposed under first metal member 510, and a second metal member 520 welded to first metal member 510 for supporting the filament 600. The filament 600 is in contact with the lower surface of first metal member 510.

Here the porous pellet 500 comprises tungsten (W), molybdenum (Mo), ruthenium (Ru), nickel (Ni) and/or tantalum (Ta), and the material used for first and second metal members 510 and 520 includes molybdenum (Mo), tantalum (Ta) and/or tungsten (W). On a surface of one pellet 500 of the present invention, a coating layer (not shown) including osmium (Os), ruthenium (Ru) and/or iridium (It) is formed.

In the present invention, it is preferred that the diameter and thickness of pellet 500 be 0.4–2.0 mm and 0.2–1.0 mm, respectively, and the diameter and thickness of the first and second metal members 510 and 520 be 0.3–3.10 mm and 20–200 μm, respectively. It is also preferred that the diameter of filament 600 disposed between the first and second metal members is 30–200 μm. For the welding of first metal member 510 and second metal member 520, laser welding, arc welding or plasma welding can be employed. Further, it is preferred that filaments be arranged cross-wise or radially, for more efficient pellet heating.

A preferred embodiment of a manufacturing method of the directly heated cathode structure according to the present invention is described in detail below.

Figure 5:
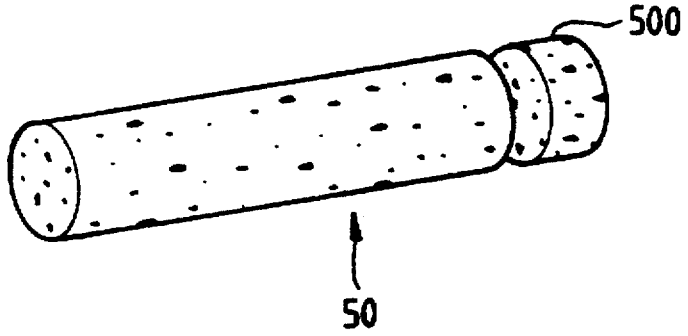
FIGS. 5–9 are process drawings for explaining a method for manufacturing the directly heated cathode structure according to the present invention.

Primarily, as shown in FIG. 5, powder of tungsten (W), molybdenum (Mo), ruthenium (Ru), nickel (Ni) and/or tantalum (Ta) is compression-shaped into a column and then sintered. When the sintering is completed, the column of material 50 is severed at a predetermined length to obtain a unit porous pellet 500. Here, the cross section of the pellet may be circular or polygonal.

Figure 6:
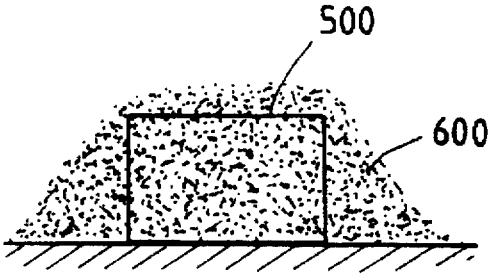

Then, as shown in FIG. 6, porous pellet 500 is contacted by cathode material 600 and heated to a high temperature so that the cathode material is impregnated into cavities of the porous pellet.

Figure 7:
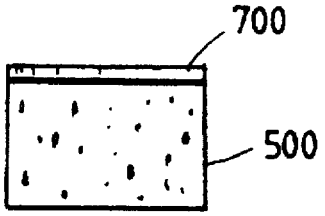

Next, as shown in FIG. 7, after setting the lower surface of pellet 500 upside down, a brazing weld layer 700 including ruthenium (Ru) and/or Molybdenum (Mo) is formed on the lower surface of the pellet to a thickness of 10–100 μm.

Figure 8:
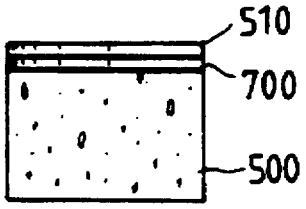

As shown in FIG. 8, a first plate metal member 510 including molybdenum (Mo), tungsten (W) and/or tantalum (Ta) is contacted by brazing weld layer 700, and then, first plate metal member 510 and brazing weld layer 700 are heated to a high temperature so that first metal member 510 is attached to the lower surface of the pellet by melted brazing weld layer 700.

Figure 9:
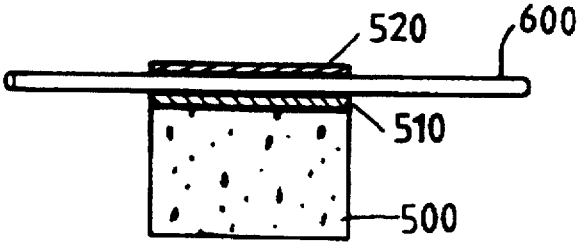

Then, as shown in FIG. 9, a single filament or crossed filament 600 is arranged on first metal member 510, and a second plate metal member 520 is put thereon. Then, the second metal member is welded to first metal member so that a cathode structure of the present invention is obtained.

On the other hand, in another embodiment of the present invention, the step in which the cathode material impregnates the pellet is performed after the first metal member is coupled to the pellet by a brazing weld, unlike the above-mentioned embodiment. Accordingly, the order of impregnation of the cathode material can be changed, if required, in the manufacturing method of the directly heated cathode according to the present invention.

The cathode structure manufactured by the above method of the present invention has various advantages, since the filament is fixed to the lower surface of pellet 500 between the first and second plate members.

First, when the cathode material impregnation is performed after the first-member brazing weld step, oxidation of the electron radiating material due to the brazing weld can be prevented.

Second, since the lower surface of the pellet is completely closed by the first metal member which is brazed welded, evaporation of the electron radiating material through the lower surface of the pellet can be blocked. Thus, continual thermonic emission is possible and the life of the cathode structure is prolonged.

Third, the structure of the filament fixed to the pellet is stabilized against external impact.

Fourth, since thermion radiating material does not escape through the lower surface of the pellet, embrittlement of the filament can be prevented.

As described above, the cathode structure manufactured according to the present invention can contribute to the improvement of product quality and productivity due to the strong pellet structure and improved weld process.

Also, the cathode structure according to the present invention can be used in color CRTs for large-screen televisions and computer monitors, as well as in small black-and-white CRTs.

What is claimed is:

1. A directly heated cathode structure comprising:

a porous pellet impregnated with a thermionic cathode material and having opposed first and second surfaces;

a first metal member fixed to the first surface of said porous pellet;

a second metal member welded to said first metal member; and a filament interposed between said first and second metal members.

2. The directly heated cathode structure according to claim 1, wherein said pellet and said first metal member are fixed with a brazing weld layer.

3. The directly heated cathode structure according to claim 2, wherein said brazing weld layer includes at least one metal selected from the group consisting of ruthenium and molybdenum.

4. The directly heated cathode structure according to claim 1, wherein said filament fixed between said first and second metal members is arranged radially.

5. The directly heated cathode structure according to claim 2, wherein said filament fixed between said first and second metal members is arranged radially.

6. The directly heated cathode structure according to claim 3, wherein said filament fixed between said first and second metal members is arranged radially.

7. The directly heated cathode structure according to claim 1, wherein said pellet includes at least one metal selected from the group consisting of tungsten, ruthenium and molybdenum nickel, and tantalum.

8. The directly heated cathode structure according to claim 2, wherein said pellet includes at least one metal selected from the group consisting of tungsten, ruthenium and molybdenum nickel, and tantalum.

9. The directly heated cathode structure according to claim 3, wherein said pellet includes at least one metal selected from the group consisting of tungsten, ruthenium and molybdenum nickel, and tantalum.

10. The directly heated cathode structure according to claim 1, wherein said pellet includes a metal selected from the group consisting of tungsten and molybdenum.

11. The directly heated cathode structure according to claim 2, wherein said pellet includes a metal selected from the group consisting of tungsten and molybdenum.

12. The directly heated cathode structure according to claim 3, wherein said pellet includes a metal selected from the group consisting of tungsten and molybdenum.

13. The directly heated cathode structure according to claim 1, wherein at least one of said first and second metal members includes at least one metal selected from the group consisting of molybdenum, tungsten and tantalum.

14. The directly heated cathode structure according to claim 2, wherein at least one of said first and second metal members includes at least one metal selected from the group consisting of molybdenum, tungsten and tantalum.

15. The directly heated cathode structure according to claim 3, wherein at least one of said first and second metal members includes at least one metal selected from the group consisting of molybdenum, tungsten and tantalum.

16. The directly heated cathode structure according to claim 1, wherein the diameter and thickness of said porous pellet range from 0.4–2.0 mm and 0.2–1.0 mm, respectively.

17. The directly heated cathode structure according to claim 2, wherein the diameter and thickness of said porous pellet range from 0.4–2.0 mm and 0.2–1.0 mm, respectively.

18. The directly heated cathode structure according to claim 3, wherein the diameter and thickness of said porous pellet range from 0.4–2.0 mm and 0.2–1.0 mm, respectively.

19. The directly heated cathode structure according to claim 1, wherein the diameter and thickness of said second metal member range from 0.3–3.0 mm and 20–200 μm, respectively.

20. The directly heated cathode structure according to claim 2, wherein the diameter and thickness of said second metal member range from 0.3–3.0 mm and 20–200 μm, respectively.

21. The directly heated cathode structure according to claim 3, wherein the diameter and thickness of said second metal member range from 0.3–3.0 mm and 20–200 μm, respectively.

22. A directly heated cathode structure comprising:

a porous pellet impregnated with a thermionic cathode material and having opposed first and second surfaces;

a metal member fixed to the first surface of said porous pellet;

a filament in electrical contact with and extending from said metal member.

23. The directly heated cathode structure according to claim 1, wherein said filament includes at least three electrical conductors extending from said metal member.

* * * * *